US006264817B1

(12) United States Patent
Timoshenko et al.

(10) Patent No.: US 6,264,817 B1
(45) Date of Patent: Jul. 24, 2001

(54) METHOD FOR MICROPLASMA OXIDATION OF VALVE METALS AND THEIR ALLOYS

(75) Inventors: Aleksandr Vladimirovich Timoshenko; Aleksandr Grigorevich Rakoch, both of Moscow (RU)

(73) Assignee: R-Amtech International, Inc., Bellevue, WA (US)

( * ) Notice: Subject to any disclaimer, the term of this patent is extended or adjusted under 35 U.S.C. 154(b) by 0 days.

(21) Appl. No.: 09/221,173

(22) Filed: Dec. 28, 1998

(30) Foreign Application Priority Data

Dec. 30, 1997 (RU) ..... 97121205

(51) Int. Cl.[7] ..... C25D 11/00; C25D 9/00
(52) U.S. Cl. ..... 205/322; 205/229; 205/918
(58) Field of Search ..... 205/137, 229, 205/322, 918; 204/157.44

(56) References Cited

U.S. PATENT DOCUMENTS

| | | | | |
|---|---|---|---|---|
| 4,082,626 | * | 4/1978 | Hradcovsky | 204/56 R |
| 4,871,435 | * | 10/1989 | Denofrio | 204/224 |
| 5,720,866 | * | 2/1998 | Erokhine | 205/83 |

FOREIGN PATENT DOCUMENTS

| | | | |
|---|---|---|---|
| 42 09 733 A1 | 9/1993 | (DE) | C25D/11/02 |
| 0 563 671 A1 | 10/1993 | (EP) | C25D/11/02 |
| 1733507 | 11/1993 | (RU) | C25D/11/02 |
| 1783004 | 3/1994 | (RU) | C25D/11/02 |
| 2 010 040 | 3/1994 | (RU) | C25D/11/02 |
| 2006531 | 9/1994 | (RU) | C25D/11/02 |
| 2023762 | 7/1995 | (RU) | C25D/11/02 |
| 2046156 | 6/1996 | (RU) | C25D/11/02 |
| 2 065 895 | 8/1996 | (RU) | C25D/11/02 |
| 1156409 | 2/1997 | (RU) | C25D/11/02 |

OTHER PUBLICATIONS

Gunther Schulze et al., *Zeitschrift Fur Physik,* 91 (1934), pp. 70–96.
Vansovskaya, Galvanic Coatings, Moskva, Mashinostroenie, 1984, p. 78, No Month Available.
Chernenko et al., Generating Coatings with an Anodic Spark Electrolytic Bath, Leningrad, Khimiya, 1991, pp. 85–90, No Month Available.

* cited by examiner

*Primary Examiner*—Kathryn Gorgos
*Assistant Examiner*—J. Maisano
(74) *Attorney, Agent, or Firm*—Birch, Stewart, Kolasch & Birch, LLP

(57) ABSTRACT

A component is immersed into an electrolyte with a specific speed and an initial polarizing current intensity is applied, which is high enough to generate on the surface of the treated component, which is immersed in the electrolyte, moving microplasma discharges. The component is held until the formation of a coating of a specific thickness. The lowering phase of the voltage, at which a coating forms, is carried out by lowering the voltage to a value which corresponds with the beginning of the extinction of the microplasma discharges and then maintaining it until the complete extinction of the isolated wandering microplasma discharges. Then the component is taken out of the electrolyte and is cooled. The method is realized with a device, containing a tank with a cooling agent, in which the electrolytic bath is located, a control block, and a mechanism to vertically and horizontally move the treated component with the capability of moving with this mechanism the given component out of the electrolytic bath in the tank with the cooling agent.

4 Claims, 1 Drawing Sheet

METHOD FOR MICROPLASMA OXIDATION OF VALVE METALS AND THEIR ALLOYS

FIELD OF THE INVENTION

The invention concerns the microplasma-electrochemical processing of the surface of metallic objects, and especially methods and devices for microplasma oxidation of valve metals and their alloys. The invention can be applied in mechanical engineering, aircraft construction, the petrochemical and oil industries, and many other branches of industry. One special area for its application is the manufacturing of components, the surfaces of which operate under conditions of friction, e.g. slide bearing bushes, transition pieces, valves of pneumatic devices, turbine blades, pistons and cylinders of engines, etc.

BACKGROUND OF THE INVENTION

Components which operate under conditions of friction or abrasion are traditionally made of antifrictional alloys (cast iron, bronze). Alternatively, structural alloys, chrome- or nickel-base metallic or compound coatings are applied to the surfaces of the components. In the latter case, this has a hardening effect on the surface. However, as with the use of antifrictional alloys, the abrasion resistance parameters stay low because of the insufficient hardness of the friction surfaces. This leads to a quick abrasion of the expensive components and makes it necessary to periodically change them during their period of use.

Vansovskaya describes an electrochemical method to generate a hard and abrasion-resistant coating. Vansovskaya, G. A.: "Galvanitcheskie pokrytiya" (Galvanic coatings), Moskva, Mashinostroenie, 1984, p. 78. This method consists in applying a chrome layer of a certain thickness to the surface of a component which operates under conditions of abrasion. The method is characterized by the use of an aggressive and toxic electrolyte (chromic anhydride) and a high current density (up to 60 A/dm$^2$). These are crucial for the conditions under which the technological process itself is being conducted as well as for the quality of the preliminary processing of the surface. The slightest deviations lead to a weak cohesion of the coating with the surface of the component to which the coating is applied and as a result of this, to the exfoliation during the period of use.

SU 1783004 describes a method for microplasma oxidation of valve metals and their alloys, mainly aluminum and titanium. Avtorskoe svidetelstvo SSSR 5 1783004, published in 1992. For this method an aqueous solution of electrolytes, containing phosphate, borate, and tungsten alkali metal is used. In the beginning of the processing of the surface, a voltage is applied (up to 360 V), during which a coating begins to form. During this process the current density is maintained constant (0.1 A/cm$^2$). The given voltage and current parameters are maintained for a period of 1 to 3 minutes and the voltage is then decreased to zero over a 1½ minute period.

The presented method is characterized by a series of restrictions in terms of the result that is achieved; these restrictions are the following:

- it is practically impossible to generate thick and abrasion-resistant coatings; and
- there are considerable energy expenditures during the process of applying the coatings to the relatively large surfaces. The above-mentioned insufficiencies restrict a wider application of the technique.

The most similar method in terms of the underlying technology is an electrochemical microarc technique of applying silicate coatings to aluminum components. Patent of the Russian Federation 2065895, published in 1996. With this technique, the components, which are to be treated, are stepwise—in 4 to 7 cycles—immersed in an electrolytic bath with a sodium silicate, polyphosphate and arzamite-base electrolyte. Here, in the beginning of the process, when the components are being immersed in the electrolytic bath, an initial current density in the range of 5 to 25 A/dm$^2$ is applied to only 5 to 10 % of their total surface area and maintained constant during the following stepwise immersion. The main insufficiencies of this method are the following:

1. The complexity of the process, as it is necessary to organize the stepwise immersing and the controlling of the surface area of the components which are immersed in the electrolyte, and also to control and regulate the required current density level;
2. The coatings which are generated have a relatively low abrasion resistance, due to the chemical nature of the used electrolyte as well as the technological operations being conducted; and
3. The method can only be used for the application of coatings to aluminum components. A change in the nature of the metal and of the chemical composition does not allow to generate high-quality coatings in terms of abrasion resistance and corrosion resistance parameters. These insufficiencies prevent a wider acceptance of the method.

SUMMARY OF THE INVENTION

The present invention solves the technical task of generating abrasion-resistant coatings of a specific thickness on the surfaces of components which are made of valve metals and their alloys with components of different chemical nature. It also improves the technological effectiveness of the coating technique and reduces the energy expenditures for this process while raising the quality of the coating.

Apart from a high abrasion resistance of the components treated by the method, the present method for microplasma oxidation also makes it possible to achieve a high corrosion resistance, which allows a substantial extension of the operational life of chemical reactors, pumps and units and components of devices which are operating in aggressive environments.

In accordance with the present invention, a component is immersed into an electrolyte with a specific speed and an initial polarizing current intensity is applied, which is high enough to generate on the surface of the treated component, which is immersed in the electrolyte, moving microplasma discharges. The component is held until the formation of a coating of a specific thickness. The lowering phase of the voltage, at which a coating forms, is carried out by lowering the voltage to a value which corresponds with the beginning of the extinction of the microplasma discharges and then maintaining it until the complete extinction of the isolated wandering microplasma discharges. Then the component is taken out of the electrolyte and is cooled. The method is realized with a device, containing a tank with a cooling agent, in which the electrolytic bath is located, a control block, and a mechanism to vertically and horizontally move the treated component with the capability of moving with this mechanism the given component out of the electrolytic bath in the tank with the cooling agent.

DETAILED DESCRIPTION OF THE INVENTION

The method

Figure 1:
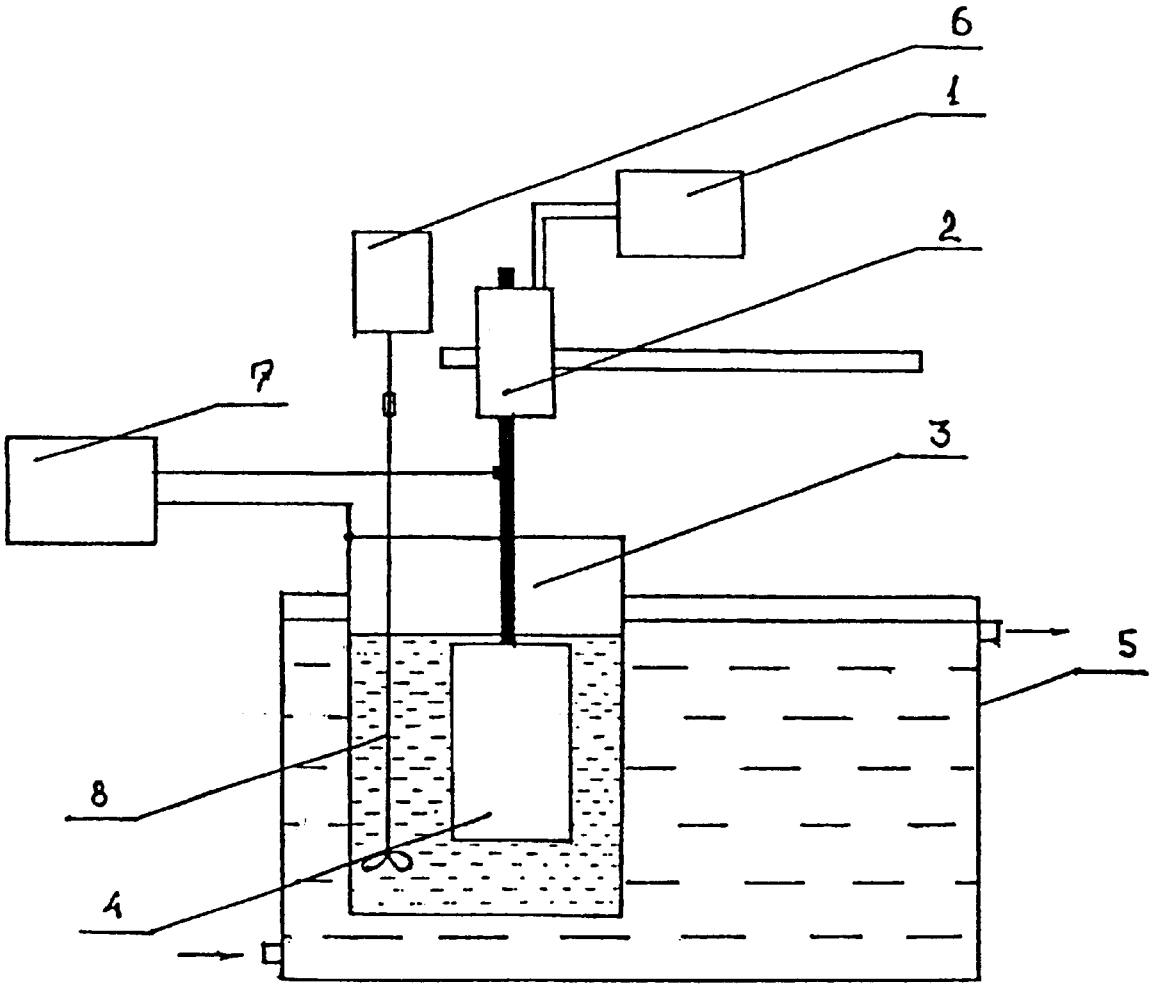
FIG. 1 shows a sketch of the device for the microplasma oxidation of valve metals and their alloys.

The above-mentioned technical result is achieved by modifying the well-known method for microplasma oxidation of valve metals and their alloys which comprises the following steps:

immersing the component in the electrolyte;

applying an initial polarizing current in the electric circuit, which current is high enough to form moving microplasma discharges on the surface of the treated component, immersed in the electrolyte;

holding the component till the formation of a coating of a specific thickness;

removing the forming voltage;

taking out the component; and rinsing the component with water.

Two key features of the present invention are:

1) The immersing phase of the component in the electrolyte is done at a constant speed V, $dm^2$/min, which is determined by the relation:

$$V=A\cdot\exp(B\cdot N) \quad (1)$$

with:

N-power output of the power supply, N-(0.05-3)·$10^5$ (Volt-Ampere) and A,B—coefficients, depending on the nature of the metal or the chemical composition of the alloy which is exposed to the microplasma oxidation; and 2) The lowering phase of the voltage, at which a coating forms, is done by lowering the voltage to a value, which corresponds with the beginning of the extinction of the microplasma discharges, and then maintaining the voltage up to the moment of complete extinction of the isolated moving microplasma discharges.

Experiments studying the influence of the immersion speed of the component in the electrolyte on energy expenditure during the coating process of the objects and on the abrasion resistance of their surfaces have shown that their optimal values are in a sufficiently low immersion speed range, with the immersion speed being determined by the values of the coefficients A and B in equation (1).

Thus for the microplasma oxidation of deformable aluminum alloys, the dependency of the immersion speed of the components in the electrolyte (V, $dm^2$/min) on the strength of the power supply (N) can be described by the equation (1), where A can have values ranging from 0.21 to 0.29 and B has a value ranging from 2.0* $10^{-5}$ to 2.1* $10^{-5}$ (in the following the dimensions of the parameters A and B are omitted).

For the microplasma oxidation of casting aluminum alloys, containing up to 8% of silicon, this dependency can accordingly be described in form of equation (1), where A has a value ranging from 0.07 to 0.09 and B has a value ranging from 2.1* $10^{-5}$ to 2.2* $10^{-5}$; for titanium alloys, containing up to 10% of alloy elements: A ranges from 0.41 to 0.42 B ranges from 1.7* $10^{-5}$ to 1.8* $10^{-5}$ for zirconium and hafnium alloys, containing up to 4% of alloy elements: A ranges from 0.38 to 0.4 B has the value 1.8* $10^{-5}$; for aluminized steel: A ranges from 0.19 to 0.28, B ranges from 1.9* $10^{-5}$ to 2.25* $10^{-5}$.

A considerable number of experiments made it possible to determine that the coefficient A changes in a range of (0.05–0.5) $dm^2$/min; the coefficient B, however, changes in a range (1.5–2.5)* $10^{-5}$/Volt* Ampere.

During the immersion, the surface of the component wetted by electrolyte increases and as a result of this, the polarizing current density and the voltage applied between the component and the electrolytic bath decrease. By regulating the immersion speed of the component, which means by regulating the speed with which the surface of the component is wetted, it is possible to keep the value of the polarizing current density within limits, within which the microplasma oxidation process can take place, which provides abrasion-resistant coatings.

Exceeding a specific immersion speed value the microarc oxidation process can come to a complete standstill with the coating which has already been formed, dissolving. If the immersion speed value of the component is too small, isolated arcs of high energy capacity can be observed, which leads to the local destruction of the coating and as a result of this, to a low abrasion-resistance and low protection of the coated component against corrosion.

Since during the formation of the coating small pores form in it, healing of the pores is necessary to increase the corrosion resistance of the coating. In this context, it is necessary that the microplasma oxidation process takes place (is-contained) only in these pores; that means that the formation of chemical compounds (mainly oxides) takes place only in the pores. In practice, complete healing is accompanied by the self-extinction of the microplasma oxidation process.

If the voltage is decreased to a value corresponding with the beginning of the extinction of the microplasma discharges, after a while isolated discharges begin to ignite in the pores of the coating, resulting in the healing of the pores, when this state is continued for a specific period of time.

A contrasting analysis of the proposed invention with the prior art shows that the presented method is different from the known one in terms of the immersion speed of the components and the regime of decreasing the forming voltage and maintaining it from the beginning of the extinguishing to the complete disappearing of isolated microplasma discharges. All the above-listed factors guarantee the solution of the set task, that is, 1. Obtaining abrasion-resistant coatings of a specific thickness, not only on the surfaces of aluminum components, but also other valve metals and their alloys with elements of different chemical nature; and 2. Raising the technological effectiveness of the coating method and the energy expenditure for this process.

The prior art shows that all the above-stated factors are not known. Thus, these factors impart novelty to the invention. Taking into account the fact that the immersion speed for the different alloys and the levels of decreasing the forming voltage and maintaining it until the complete extinction of the microplasma discharges, were gathered experimentally, originating from the earlier mentioned demands on the microplasma oxidation process and the quality of the generated coatings, the above-mentioned factors non-obviousness to the invention. Since the electrolyte consists of known components and the presented method involves well-known operations (immersion, application of voltage, holding of the component, removal of the forming voltage, rinsing of the component), the above-indicated factors impart "industrial applicability" to the invention.

The apparatus

For an effective and practical realization of the present method a unique device has been developed. In this connection, another object of the present invention is a device for the microplasma oxidation of the surface of components, their valve metals and the alloys on their basis.

Devices for generating oxide coatings on valve metals, consisting of a power supply with high output characteristics for the electric current and the voltage, a plating bath with a component being oxidized, which are connected with each other through current conductors supplying them with power are disclosed by Vansovskaya and Chernenko. Vansovskaya, G.A.: "Galvanitcheskie pokrytiya" (Galvanic coatings), Moskva, Mashinostroenie, 1984, p. 78; Chernenko, V.I. and others: "Poluchenie pokrytij anodnoiskrovym elektrolizerom" (Generating coatings with an anodic spark electrolytic bath), Leningrad, Khimiya, 1991, p. 85–90.

The application of those devices is very much restricted because their functioning is based on the complete immersion of the treated component in the plating bath. This makes it impossible to use those devices for the application of oxide coatings to the surfaces of large components, and especially components with an irregular profile, because for reaching the coating formation voltage, very high current values and a long build-up time are required, which in economic terms is not very efficient.

The most similar to the present device is the one for microarc oxidation of components of chemical equipment, containing an electrolytic bath with an electrolyte, a power supply, a tank for the electrolyte, a voltage comparison unit, a signal transformer, a transfer pump and regulating control valves, where the power supply is connected through the voltage comparison unit and the signal transformer with the regulating control valves, which are set up in lines, connecting the electrolytic bath, the transfer pump and the tank for the electrolyte. Patent of the Russian Federation 2010040, published in 1994.

The insufficiencies of the described device are the following:

- the bulkiness of the device, due to the necessity of having two tanks with electrolyte and one for the rinsing,
- an increased power consumption, due to the necessity of pumping the electrolyte from the working tank in the reserve tank and back, and
- the difficulty of maintaining the given regime of simultaneous oxidation of a huge number of small components. The above-listed insufficiencies are preventing a wider acceptance of those devices.

An object of the present invention is to lower the energy consumption during the coating process, to improve the compactness of the device, and also to raise the quality of the generated oxide coatings while expanding the range of metals used for the coating.

The above-indicated object is achieved by modifying the known device for generating coatings with the microarc oxidation process to additionally comprise a mechanism to vertically and horizontally move the component (components) with a control block, and by positioning the electrolytic bath within the cooling tank with a coaxial shift in relation to the axis of the tank. In accordance herewith the capacity of the tank is at least three times higher than the capacity of the electrolytic bath.

The prior art shows that all the above-stated factors are not known. Thus, these factors impart novelty to the invention. Because the device consists of known components, the above-indicated factors satisfy the requirement that the invention be useful. Because the geometrical characteristics and relations of the parts of the device were deduced experimentally, the above-mentioned factors impart non-obviousness to the invention.

FIG. 1 shows a sketch of the device for the microplasma oxidation of valve metals and their alloys. The device consists of a control block for the mechanism moving the component 1, a mechanism 2 to vertically and horizontally move the component with a holding device, an electrolytic bath 3 with an electrolyte, the treated component 4, a tank 5 with a cooling agent (e.g. circulating water) to cool the electrolyte and rinse the treated component 4, an electromotor 6, power supply 7 with a control desk, a mixer 8 to stir the electrolyte, which is connected with the electromotor 6. The electrolytic bath 3 can be positioned in the tank 5 with a shift in relation to the axis of the tank 5 and the capacity of the tank is at least three times higher than the capacity of the electrolytic bath 3. In this case, the cooling agent which is in the tank 5 is also performing the function of a rinsing agent.

EXAMPLE

The technique for operating the given device has been realized in the following way.

To generate an abrasion- and corrosion-resistant coating a plane disc of casting aluminum alloy (Al 22) containing up to 15% of alloy components and with a total surface area of 32 $dm^2$ has been used. The component has been fixed in the holding device which is tightly connected with the mechanism 2 to vertically and horizontally move the component. In the control block for the mechanism moving the component 1, the instruction has been given to vertically immerse the component 4 in the electrolyte, which has been poured in the electrolytic bath 3 with a specific speed which preliminarily has been calculated according to the equation $V=A\cdot\exp(B\cdot N)$ (1). In this case, the immersion speed for casting aluminum alloy amounted to 0.26 $dm^2$/min. The output power of the power supply amounted to 60000 Volt-Ampere. The electrolyte used, in this case, was composed in the following way (mass-%):

| | | |
|---|---|---|
| 1) | NaOH | 0.3 |
| 2) | $Na[AlOH]_4$ | 0.5 |
| 3) | remelted monosubstituted sodium phosphate | 0.5 |
| 4) | aqueous extract of raw material of plant origin, won by a mass ratio of raw material and extract of Iess than O.O1 | 12.0 |
| 5) | water | the rest |

Experiments have also been conducted for a series of electrolytes of different composition which can be found in the cited references.

After giving the instruction to lower the component 4 and the beginning of its immersion into the electrolyte, the power supply 7 is switched on and a polarizing current intensity of 120 A is applied, which is changing according to equation (1) according to the immersion degree of the component 4 in the electrolyte. The electromotor 6 is switched on, starting the mixer 8, stirring the electrolyte.

The voltage providing the initial applied polarizing current intensity is high enough to generate microplasma discharges.

According to the immersion scale of the component 4, the surface area wetted by electrolyte is increasing, the zone of microplasma discharges is scanned on the immersion surface of the component 4. During the above-indicated wetting speed of the surface of the component, the voltage is kept at a level which is high enough to maintain the burning of the discharges on the overall wetted surface (approximately 550–600 V), up until the complete immersion of the component 4 in the electrolyte.

After the immersion of the component 4 in the electrolyte, the component is held (in this position) over a period of 35 to 45 minutes, during which the coating is applied to the surface of the component. Hereby, on the whole surface of the component 4 moving microarcs are burning, and then the forming voltage is lowered to a value which conforms with the beginning of the extinction of the microplasma discharges (e.g. up to 380 to 430 V) and the appearance of isolated wandering microplasma discharges. The ignition of the isolated discharges is restricted to the pores of the coating of the component 4. Then the voltage is maintained until the complete extinction of the isolated wandering microplasma discharges over a period of 10 to 14 minutes. Only after this operation the power supply 7 is switched off. It should be mentioned that the positioning of the electrolytic bath 3 in the tank 5 with the cooling agent (e.g. circulating water)is contributing to its cooling, which means to the improvement of the thermal conditions of its functioning.

In the control block 1 for the mechanism moving the component 4 the instruction is given to vertically lift the component 4, to horizontally move it and to vertically immerse it in the tank 5 with circulating water acting as the cooling agent. In the tank then, the component 4 is rinsed with this water. In this case, the cooling agent is acting as wash liquid. After the rinsing of the component 4 the instruction is given to vertically lift the component 4 out of the tank 5. After that it is taken out of the holding device.

As a result of the conducted operations a coating has been generated which has the following characteristics: a thickness of 68 micrometers; a microhardness in the middle part of the coating of 20 HPa; a chemical stability of 45 minutes; an electric strength of 43 V/micrometer. Hereby, the thickness and microhardness of the generated coatings have been determined by the cross sections with the device PMT-3. The chemical stability has been evaluated by the time passing until the destruction of the coating in the solution, containing 300 g/l of hydrochloric acid and 200 g/l of cupric chloride. The electric strength of the coating has been determined by dividing the value of their breakdown voltage by the thickness. The breakdown voltage of the coatings has been measured in air, by applying to the surface of the coatings a voltage from the positive pole of the constant current source. The clamping contact had a spherical (diameter of 2 mm) or a plane surface (1 $cm^2$). The stress on the clamping contact amounted to about 10 N. It has to be said that the examination of the dependency of the immersion speed of the component in the electrolyte has been carried out in a wide range of the output power of the power supply—from 5 kVA to 300 kVA—and the results have shown the correctness of the given formula.

The above-mentioned parameters of the generated coating allow the statement that the present method achieves the set object with high parameters and that the device allows the generation of high-quality coatings in a wide range of samples of the invention while keeping the costs low, which often cannot be achieved with the other known methods and devices.

What is claimed is:

1. A method for microplasma oxidation of valve metals and their alloys, including the following steps:

immersion of the component in the electrolyte, application of an initial polarizing current power in an electric circuit, which is high enough to generate on the surface of the component, which is immersed in the electrolyte, moving microplasma discharges, holding of the component until the formation of a coating of a specific thickness, and removal of a forming voltage and taking out the component and then rinsing the component, characterized in that the immersion of the component in the electrolyte is done at a constant speed which is determined by the relation:

$$V=A\cdot\exp(B\cdot N)$$

with:

V=immersion speed of the component, $dm^2$/min;

N=output power of the power supply, N-(0.05-3)$\cdot 10^5$ (Volt·Ampere);

A—(0.05–0.5)$dm^2$/min;

B=(1.5–2.5)$\times 10^{-5}$(1/Volt·Ampere), and after the formation of the coating is completed, the voltage in the electric current is lowered until isolated wandering microplasma discharges appear on the treated surface; and the treated surface of the component, which is immersed in the electrolyte, is held therein until complete extinction of the isolated wandering microplasma discharges occurs.

2. A method for microplasma oxidation of valve metals and their alloys, comprising the steps:

immersing a component in the electrolyte at a constant speed which is determined by the relation:

$$V=A\cdot\exp(B\cdot N)$$

wherein: V=the immersion speed of the component, $dm^2$/min; N=the output power of the power supply, N–(0.05–3)$\cdot 10^5$(Volt·Ampere); A=(0.05–0.5)$dm^2$/min; and B=(1.5–2.5)$\times 10^{-5}$(1/Volt·Ampere);

applying an initial polarizing current power in the electric circuit, which current is high enough to generate moving microplasma discharges on the surface of the treated component immersed in the electrolyte, until formation of a coating of a desired thickness is completed; and lowering the voltage in the electric current until isolated wandering microplasma discharges appear on the treated surface; and holding the treated surface of the component, which is immersed in the electrolyte, therein until complete extinction of the isolated wandering microplasma discharges occurs.

3. The method of claim 2, wherein said initial polarizing current power is applied for approximately 35–45 minutes and wherein complete extinction of the isolated wandering microplasma discharges occurs in approximately 10–14 minutes.

4. The method of claim 2, wherein V is approximately 0.26$dm^2$/min.

* * * * *